US012540442B2

(12) United States Patent
Casas

(10) Patent No.: US 12,540,442 B2
(45) Date of Patent: Feb. 3, 2026

(54) RAILWAY WORKS MACHINE COMPRISING A MACHINE CHASSIS AND A WORKS SHUTTLE, AND ASSOCIATED RAILWAY WORKS CONVOY

(71) Applicant: Matisa Materiel Industriel S.A., Crissier (CH)

(72) Inventor: Gabriele Casas, Crissier (CH)

(73) Assignee: Matisa Materiel ndustriel S.A., Crissier (CH)

( * ) Notice: Subject to any disclaimer, the term of this patent is extended or adjusted under 35 U.S.C. 154(b) by 704 days.

(21) Appl. No.: 17/906,513

(22) PCT Filed: Mar. 18, 2021

(86) PCT No.: PCT/EP2021/057032
§ 371 (c)(1),
(2) Date: Sep. 16, 2022

(87) PCT Pub. No.: WO2021/186007
PCT Pub. Date: Sep. 23, 2021

(65) Prior Publication Data

US 2023/0143617 A1 May 11, 2023

(30) Foreign Application Priority Data

Mar. 20, 2020 (FR) ..... 2002757

(51) Int. Cl.
*E01B 27/02* (2006.01)

(52) U.S. Cl.
CPC ..... *E01B 27/028* (2013.01); *E01B 2203/12* (2013.01)

(58) Field of Classification Search
CPC ... E01B 2203/10; E01B 27/17; E01B 2203/12
See application file for complete search history.

(56) References Cited

U.S. PATENT DOCUMENTS 4,430,944 A 2/1984 Theurer
4,596,193 A 6/1986 Theurer
(Continued)

FOREIGN PATENT DOCUMENTS

CH 648621 A5 3/1985
CN 1041800 A 5/1990
(Continued)

OTHER PUBLICATIONS

International Search Report and Written Opinion mailed May 19, 2022, in connection with International Patent Application No. PCT/EP2021/057032, filed Mar. 18, 2021, 19 pgs. (including translation).

(Continued)

*Primary Examiner* — Paul N Dickson
*Assistant Examiner* — Maxwell L Meshaka
(74) *Attorney, Agent, or Firm* — Chiesa Shahinian & Giantomasi PC

(57) ABSTRACT

A railway works machine comprises a machine chassis and a works shuttle, the machine chassis having two opposite longitudinal end portions and a middle portion connecting the opposite longitudinal end portions, a volume being created underneath the middle portion of the machine chassis to house at least part of the works shuttle. The shuttle chassis is able to move with respect to the machine chassis back and forth between two end-of-travel positions. A longitudinal locking system allows the machine chassis to be secured to the shuttle chassis in a position for travel. The longitudinal locking system comprises a first locking device locking together a first of the two longitudinal end portions and the shuttle chassis and a second locking device locking together the shuttle chassis and a second of the two longitudinal end portions.

20 Claims, 7 Drawing Sheets

(56) References Cited

U.S. PATENT DOCUMENTS

| | | | | |
|---|---|---|---|---|
| 4,632,037 | A | 12/1986 | Theurer et al. | |
| 4,643,101 | A * | 2/1987 | Theurer | E01B 27/17 104/7.2 |
| 4,644,868 | A | 2/1987 | Theurer | |
| 4,733,614 | A * | 3/1988 | Mohr | E01B 27/17 74/110 |
| 4,770,104 | A * | 9/1988 | Theurer | E01B 27/02 37/104 |
| 4,794,862 | A * | 1/1989 | Theurer | E01B 27/105 37/104 |
| 4,928,599 | A | 5/1990 | Hansmann et al. | |
| 4,953,467 | A * | 9/1990 | Theurer | E01B 35/04 104/12 |
| 5,101,733 | A * | 4/1992 | Mohr | E01B 27/17 104/2 |
| 5,515,788 | A * | 5/1996 | Theurer | E01B 27/17 104/7.2 |
| 5,619,929 | A * | 4/1997 | Theurer | E01B 27/13 104/2 |
| 6,481,358 | B2 | 11/2002 | Theurer et al. | |
| 6,705,232 | B2 * | 3/2004 | Theurer | E01B 27/17 104/12 |
| 6,805,059 | B2 * | 10/2004 | Theurer | E01B 27/17 104/2 |
| 2001/0050022 | A1 | 12/2001 | Theurer et al. | |
| 2004/0003750 | A1 * | 1/2004 | Theurer | E01B 27/17 104/10 |
| 2004/0031412 | A1 * | 2/2004 | Theurer | E01B 27/17 104/12 |
| 2019/0257038 | A1 | 8/2019 | Wollanek et al. | |
| 2023/0142608 | A1 * | 5/2023 | Casas | E01B 27/16 104/12 |
| 2023/0143617 | A1 * | 5/2023 | Casas | E01B 27/028 104/12 |
| 2024/0254698 | A1 * | 8/2024 | Hofstaetter | E01B 27/17 |
| 2024/0318386 | A1 * | 9/2024 | Max-Theurer | E01B 31/13 |

FOREIGN PATENT DOCUMENTS

| | | | | |
|---|---|---|---|---|
| DE | 2738750 | A1 | 6/1978 | |
| DE | 3425637 | A1 | 12/1985 | |
| DE | 3347860 | C2 | 1/1988 | |
| DE | 202004013631 | U1 * | 12/2004 | E01B 27/17 |
| EP | 0360950 | A1 | 4/1990 | |
| EP | 1162309 | A1 | 12/2001 | |
| FR | 2476708 | A1 | 8/1981 | |
| FR | 2550808 | A1 | 2/1985 | |
| FR | 2556752 | A1 | 6/1985 | |
| FR | 2655669 | A1 * | 6/1991 | |
| FR | 2807452 | A1 | 10/2001 | |
| GB | 2151675 | A1 | 5/1987 | |
| GB | 2360057 | B | 1/2002 | |
| WO | 2018082796 | A1 | 5/2018 | |
| WO | WO-2024121053 | A1 * | 6/2024 | E01B 27/16 |

OTHER PUBLICATIONS

Office Action mailed Jun. 6, 2025, in connection with Chinese Patent Application No. 202180013981.1, 10 pgs. (including translation).

International Search Report and Written Opinion mailed May 12, 2021, in connection with International Patent Application No. PCT/EP2021/057033, filed Mar. 18, 2021, 10 pgs. (including translation).

* cited by examiner

RAILWAY WORKS MACHINE COMPRISING A MACHINE CHASSIS AND A WORKS SHUTTLE, AND ASSOCIATED RAILWAY WORKS CONVOY

CROSS-REFERENCE TO RELATED APPLICATIONS

This application is a national stage under 35 U.S.C. 371 of International Patent Application Serial No. PCT/EP2021/057032, filed Mar. 18, 2021, which claims priority to French Patent Application No. 2002757, filed Mar. 20, 2020, the disclosures of all of which are incorporated herein by reference in their entirety.

TECHNICAL FIELD OF THE INVENTION

The invention relates in particular to works for laying, maintaining or repairing a rail track. It relates more specifically, but not exclusively, to operations referred to as tamping, which consist in having tamping tools penetrate the ballast in the gap between the sleepers of the rail track, in order to mechanically compact the ballast under the sleepers.

PRIOR ART

The tamping machines are typically integrated in works trains, which comprise a plurality of cars that are coupled to one another, in order to perform successive operations required for laying, repairing or replacing the rail track. A works convoy of this kind is capable of advancing continuously, at a low speed, on the rail track, without stopping, and preferably at a constant work speed, each train machine having to provide its own functions at this work speed. The tamping operation, in turn, requires the part of the works machine which supports the tamping tools to remain stationary with respect to the rail track, for the time necessary for the tamping tools to penetrate into the ballast between two successive sleepers of the track, for the generation of a vibratory movement of the tamping tools in the ballast, and then for the retraction of the tamping tools from the ballast.

In order to reconcile these conflicting requirements, architectures of tamping machines are known, illustrated for example by the documents FR2476708 and FR2556752, in which the works machine comprises a machine chassis that is borne by two trucks arranged at the ends thereof, and a tamping shuttle comprising a shuttle chassis that is suspended from the machine chassis and guided longitudinally in translation with respect to the machine chassis, by slides, between two end-of-travel positions, the shuttle chassis bearing tamping tools that are movable perpendicularly to the plane of the rail track. The machine chassis is intended to be coupled to other cars of a works convoy and to advance at a constant work speed, on the rail track. During a work cycle, the tamping shuttle moves with respect to the machine chassis, in the direction opposed to the advancement direction of the machine train, from an initial position, at a speed that is equal in absolute value to the advancement speed, so as to remain immobile with respect to the track during the phase of penetration of the tools into the ballast, of generation of the vibratory movement of the tools in the ballast, then of retraction of the tamping tools out of the ballast. Then, once the work tools are retracted, the shuttle chassis returns towards its initial position in order to start a new cycle under the following sleeper of the track.

According to a variant shown in document FR2 550 808, the machine chassis is still borne by two end trucks, but no longer bears the shuttle chassis in its entirety, which is borne by mounts on two additional bearing trucks which travel on the rail track and are equipped, if applicable, with braking and drive means. The only connection remaining between the two chassis is a jack acting longitudinally in order to allow the alternate movement of the shuttle chassis with respect to the machine chassis.

The chassis of the works shuttle tamping machines of the prior art generally comprise a large recess for receiving the tamping shuttle. In some situations, in particular when the works machine is coupled at one of the ends thereof or at both ends and is traveling or maneuvering without working, if applicable at a travel speed that is substantially greater than the work speed, relatively significant stresses must be able to be transferred, in particular in the longitudinal direction between the ends of the machine chassis, which requires significant reinforcement in the region of the central portion having a reduced cross section, which makes the machine heavier. Moreover, similar problems exist for other railway works machines equipped with a shuttle comprising tools intended to work when the shuttle is stopped with respect to the track, without hindering the continuous advance of the railway machine. This is true in particular for the track compacting operations.

DISCLOSURE OF THE INVENTION

The invention aims to overcome at least some of these disadvantages of the prior art, and to propose means for rigidifying a works machine of the type comprising a works shuttle that is positioned under a machine chassis, at least in part.

In order to achieve this, according to a first aspect of the invention, a railway works machine is proposed, in particular for laying, maintaining or repairing a rail track, comprising a machine chassis and a works shuttle, the machine chassis having two opposite longitudinal end portions and a middle portion connecting the opposite longitudinal end portions, a volume being created underneath the middle portion of the machine chassis to house at least part of the works shuttle, the works shuttle comprising a shuttle chassis and at least one works unit, the shuttle chassis being able to move with respect to the machine chassis, in a longitudinal direction of the works machine, back and forth between two end-of-travel positions, the works machine further comprising a longitudinal locking system which is capable of securing the machine chassis to the shuttle chassis in a position for travel, characterized in that the longitudinal locking system comprises a first locking device between a first of the two longitudinal end portions and the shuttle chassis and a second locking device between the shuttle chassis and a second of the two longitudinal end portions, each of the first and second locking devices being capable of withstanding a critical load exceeding 500 kN, preferably 900 kN, and even more preferably 1500 kN, in the longitudinal direction.

The locking devices are thus dimensioned so as to transmit, via the shuttle chassis, a substantial portion of the longitudinal stresses applied to the ends of the machine chassis, which makes it possible to relieve the middle part of the machine chassis, when the shuttle chassis is in the position for travel and the first locking device and the second locking device are in the locking position.

According to one embodiment, the two opposite longitudinal end portions are each equipped with an end interface that belongs to a group of interfaces comprising shock pads and a coupling for connection to an adjacent vehicle of the works convoy. The external longitudinal stresses transmitted to one of the end interfaces are thus transmitted to the other end interface via the locking devices and the shuttle chassis.

According to one embodiment, the works unit comprises work tools that are intended to work on the track when the works shuttle is stopped, it being possible for the work tools to be for example tamping or compacting tools. The works unit preferably comprises a bearing structure that is capable of raising and lowering the work tools between a retracted position and a work position, preferably by means of a purely vertical movement.

It is possible to provide for the works machine to comprise at least one assistance actuator, preferably comprising one or more hydraulic jacks, connecting the machine chassis to the shuttle chassis, capable of performing one or more of the following operations:

- blocking the shuttle chassis with respect to the machine chassis in any intermediate position between the two end-of-travel positions;
- driving the shuttle chassis with respect to the machine chassis in a longitudinal direction of the works machine, in a back and forth movement between the two end-of-travel positions.

The end-of-travel positions are preferably at least 1 meter, preferably at least 1.5 meters, apart from one another.

The railway works machine preferably comprises at least two trucks, which are preferably motorized and have vertical pivot axes that are located at a distance from one another of preferably more than 10 meters, preferably more than 12 meters.

It is possible to envisage different designs for the trucks bearing the machine chassis and the shuttle chassis. According to a first arrangement, the two trucks bear the shuttle chassis, which bears the machine chassis. According to a second arrangement, the two trucks bear the machine chassis, on which the shuttle chassis is suspended, at least in the position for travel. According to a third arrangement, the two trucks bear the machine chassis, and the railway works machine comprises two additional trucks that bear the machine chassis.

The railway works machine may be integrated in a railway works convoy further comprising at least one additional car comprising an additional chassis coupled to the machine chassis of the works machine, and at least one additional truck for supporting the additional chassis.

According to another aspect of the invention, which can advantageously be combined with the preceding aspect, said invention relates to a works machine for a works convoy for laying, repairing or replacing a rail track, the works machine comprising a first truck and a second truck that are located longitudinally at a distance from one another and are intended for bearing the works machine, a machine chassis and a works shuttle, the works shuttle having a shuttle chassis and one or more works units that are vertically movable with respect to the shuttle chassis, the shuttle chassis being linked to the machine chassis by longitudinal guide means that allow a relative back and forth movement, between two end-of-travel positions, between the shuttle chassis and the machine chassis in a longitudinal direction of the works machine, characterized in that the machine chassis is entirely borne by the shuttle chassis which is carried by the first truck and the second truck. Thus, a works machine is achieved having a limited number of trucks, and the longitudinal guide means of which are subjected to vertical stresses which do not vary over the course of the operating cycles of the machine, since these stresses are only those resulting from the weight of the machine chassis and the elements which said chassis carries.

According to one embodiment, the longitudinal guide means comprise a first longitudinal rolling interface that is closer to the first truck than to the second truck, and a second longitudinal rolling interface that is closer to the second truck than to the first. Preferably, the first rolling interface and the second rolling interface each comprise at least one longitudinal raceway and at least one associated roller which is capable of rolling on the raceway in order to allow for the back-and-forth relative movement between the shuttle chassis and the machine chassis, the longitudinal raceway being secured to one of the two subassemblies formed by the machine chassis and the shuttle chassis, the associated roller being either translationally secured to the other of the subassemblies formed by the machine chassis and the shuttle chassis, or guided so as to roll simultaneously on the longitudinal raceway and an opposing longitudinal raceway that is secured to the other of the subassemblies formed by the machine chassis and the shuttle chassis.

For the purpose of a good balance of stresses, the machine chassis has a center of gravity that is located between the first rolling interface and the second rolling interface. Preferably, the first rolling interface and the second rolling interface are located, with respect to a center of gravity of the machine chassis, such that, when stopped on a horizontal rail track, a load distribution ratio between the first rolling interface and the second rolling interface is between 60% and 140% for every relative position of the machine chassis and of the shuttle chassis between the two end-of-travel positions.

In a more general manner, the weights are preferably distributed such that, in a median relative position of the machine chassis and of the shuttle chassis, halfway between the two end-of-travel positions, stopped on a horizontal rail track, each of the first and second trucks supports at least 40% and at most 60% of the total weight of the works machine.

According to one embodiment, the works machine comprises at least one assistance actuator, preferably comprising one or more hydraulic jacks, connecting the machine chassis to the shuttle chassis, capable of performing one or more of the following operations:

- blocking the machine chassis with respect to the shuttle chassis in any intermediate position between the two end-of-travel positions;
- driving the machine chassis with respect to the shuttle chassis in a longitudinal direction of the works machine, in a back and forth movement between the two end-of-travel positions.

The function of blocking by the assistance actuator will be implemented in particular at very low speed when, during a work sequence, the works machine must pass an item of track equipment, for example points.

According to one embodiment, the end-of-travel positions are at least 1 meter, preferably at least 1.5 meters, apart from one another.

According to one embodiment, the first truck is guided in rotation with respect to the shuttle chassis so as to pivot at least about a first vertical pivot axis, the second truck is guided in rotation with respect to the shuttle chassis so as to pivot at least about a second vertical pivot axis, the second vertical pivot axis preferably being located at a distance (D) from the first vertical pivot axis that is greater than 10 meters, preferably greater than 12 meters.

It is advantageous for the trucks of the works machine to ensure suspension of the works machine in the movement phases of the works machine at a speed higher than the work speed. In contrast, in the work phases, it is advantageous to eliminate the suspension so as to achieve a high degree of positioning accuracy of the work tools between the sleepers. For this purpose, and according to a preferred embodiment, it is provided for the first truck and the second truck to each comprise a truck chassis, at least two wheel sets, a primary suspension between the wheel sets and the truck chassis. Preferably, the primary suspension of each of the first and second trucks comprises a blocking mechanism that is capable of vertically blocking each of the wheel sets with respect to the truck chassis, at least in a bearing direction of the truck chassis on each of the wheel sets. Preferably, at least one reference truck from the first and second trucks comprises a rotational locking mechanism that is capable of securing the truck chassis of the reference truck with respect to the shuttle chassis.

According to Various Embodiments:

- the machine chassis comprises a coupling for connection to an adjacent car of the works convoy;
- at least one longitudinal end of the machine chassis is equipped with one or more shock pads;
- the works shuttle is entirely located between two opposing longitudinal ends of the machine chassis, at least in a median relative position of the machine chassis and of the works shuttle, halfway between the two end-of-travel positions, and preferably in the two end-of-travel positions;
- the machine chassis comprises a driver's cab or a control station.

According to a preferred embodiment, at least one truck from the first truck and the second truck is a motorized truck comprising at least one motorized wheel set. Preferably, each motorized truck comprises two motorized wheel sets, each driven by a traction motor, preferably a hydraulic motor. The two trucks are preferably motorized trucks. The motorized trucks can in particular be used in the work phases, if applicable in addition to the actuator described above, in order to perform the mechanical work necessary for the relative movement between the shuttle chassis and the machine chassis. They can also be used also in the movement phases of the works machine, at a speed higher than the work speed, preferably after having locked the machine chassis in position with respect to the shuttle chassis. Preferably, at least one truck from the first truck and the second truck is equipped with a break, a motorized truck comprising at least one motorized wheel set that is driven by at least one motor.

Each of the first and second locking devices is movable between a locking position and a retracted position in order to make it possible, in the locking position, to secure the machine chassis to the shuttle chassis in the position for travel, and, in the retracted position, to release the shuttle chassis.

In practice, each of the first and second locking devices is a positive engagement locking device. According to a particularly advantageous embodiment, each of the first and second locking devices comprises a bolt that is mounted on one of the two subassemblies formed by the machine chassis and the shuttle chassis, and a striker plate mounted on another of the two subassemblies formed by the machine chassis and the shuttle chassis, the bolt being movable with respect to the subassembly on which it is mounted, between a locking position and a retracted position, the bolt penetrating into the striker plate, passing from the retracted position into the locking position, and preferably being connected to an actuator.

According to another aspect of the invention, this relates to a railway works convoy comprising a works machine as described above, and at least one additional car comprising an additional chassis coupled to the machine chassis of the works machine, and at least one additional truck for bearing the additional chassis.

According to another aspect of the invention, this relates to a method for operating a works convoy as defined above on a rail track, method according to which, in a work mode, the machine chassis is pulled or pushed by the additional chassis of the additional car, on the rail track, in a work direction, preferably without stopping, preferably at a constant speed, the shuttle chassis moving longitudinally back and forth with respect to the machine chassis, so as to have stopping phases, with respect to the rail track, during which the works units penetrate the ballast of the rail track, and movement phases in the work direction. Preferably, it is ensured that, in the work mode, the works shuttle is driven by one or more motorized trucks from the first and the second truck, and/or by one or more assistance actuators connecting the machine chassis to the shuttle chassis. Preferably, the method also has a movement mode, in which the machine chassis is locked in position longitudinally with respect to the shuttle chassis.

BRIEF DESCRIPTION OF THE FIGURES

Other features and advantages of the invention will become clear from the following description, given with reference to the accompanying drawings and explained below.

For reasons of improved clarity, identical or similar elements are indicated by identical reference signs in all the figures.

DETAILED DESCRIPTION OF EMBODIMENTS

Figure 1:
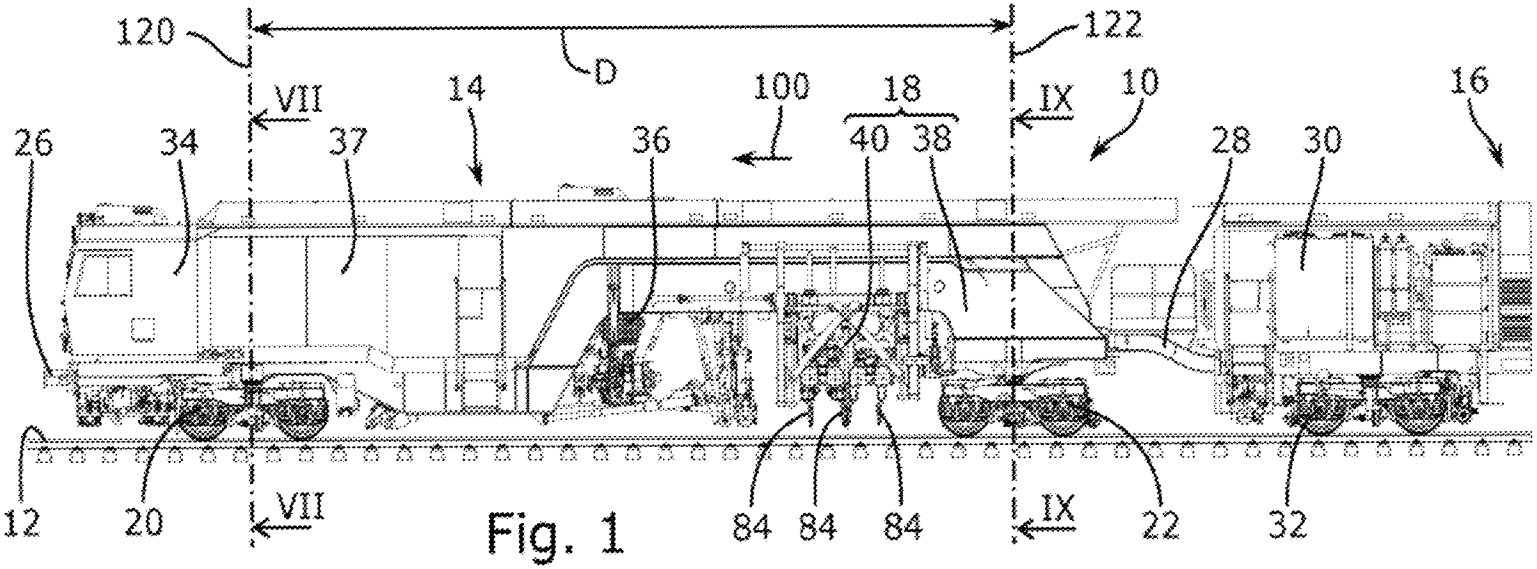
FIG. 1 is a side view of part of a convoy comprising the works machine and at least one additional car, according to one embodiment of the invention, the works machine comprising a machine chassis and a works shuttle in a first end-of-travel position.
Figure 2:
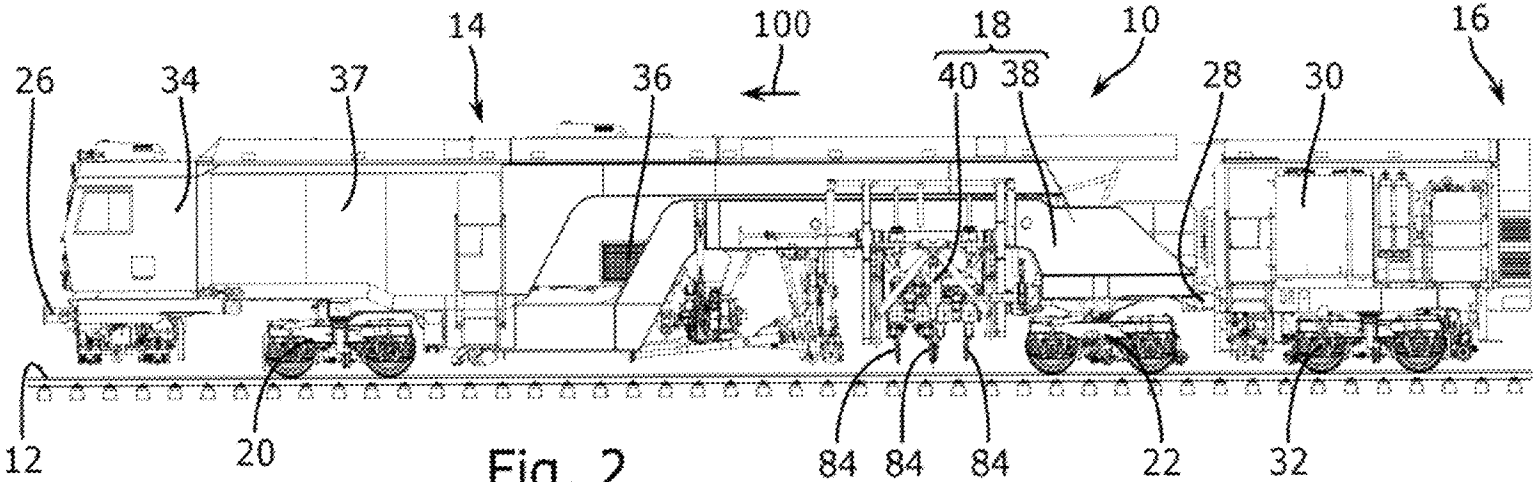
FIG. 2 is a side view of the convoy of FIG. 1, the works shuttle being in a second end-of-travel position.

FIGS. 1 and 2 show a railway works convoy 10 for maintaining or repairing a rail track 12, said train comprising a plurality of rail cars that are coupled to one another, i.e. in this case a works machine 14 which in this case is a tamping machine, and at least one additional car 16, for example a compacting machine that is located behind the works machine 14, in a direction referred to as the travel direction 100, on the rail track 12.

Figure 3:
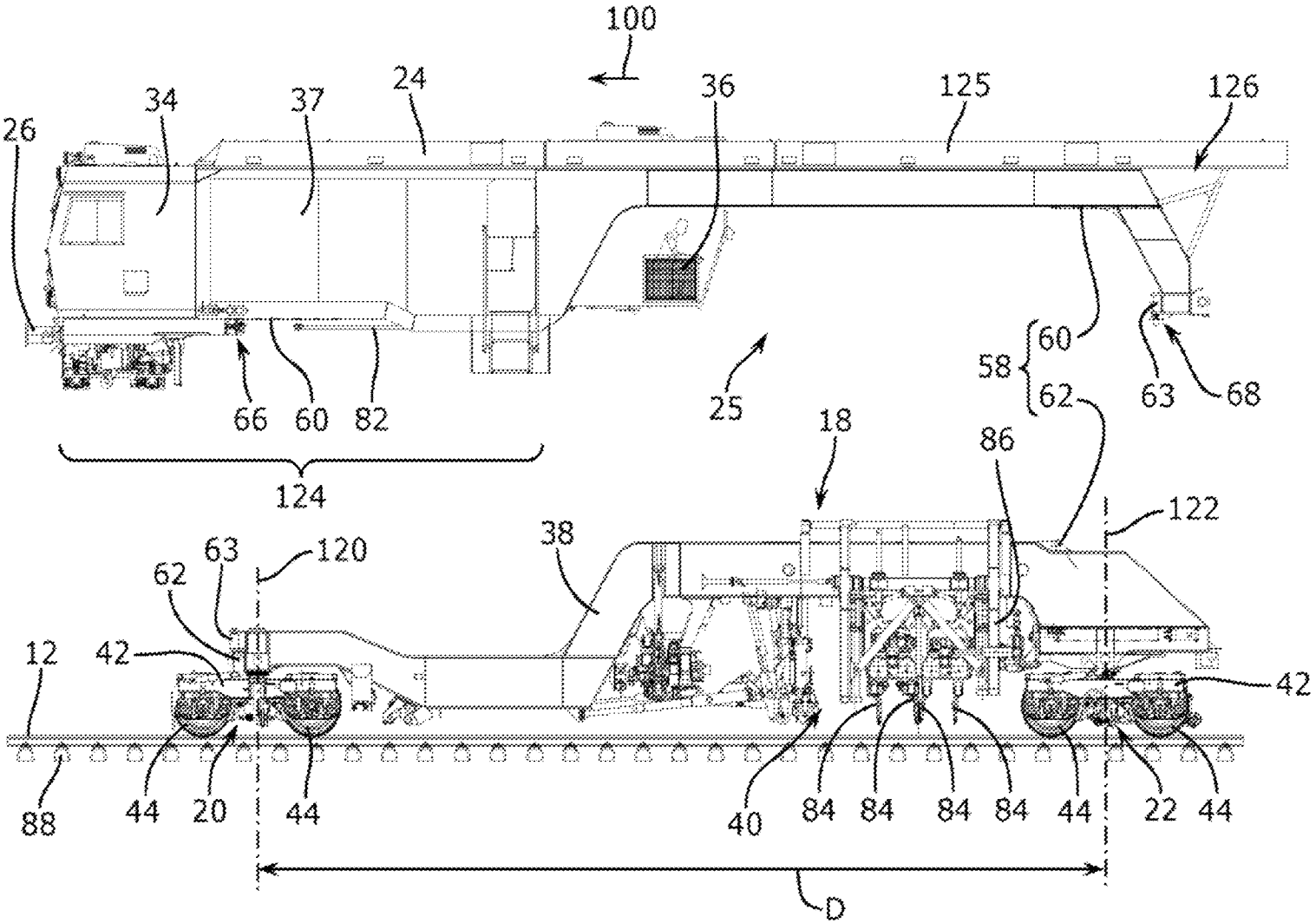
FIG. 3 is an exploded view of the works machine of the convoy of FIG. 1.

The works machine 14, shown in an exploded view in FIG. 3, comprises a works shuttle 18, in this case more specifically a tamping shuttle, carried by a first truck 20 and a second truck 22 located longitudinally at a distance from one another, as well as a machine chassis 24 carried by the works shuttle 18.

The machine chassis 24 comprises a longitudinal recess 25 for housing the works shuttle 18, said longitudinal recess 25 being spanned by a longitudinal bridge 125 having a small cross section that constitutes a median portion of the machine chassis 24 and connects two opposite longitudinal end portions 126, 128 having a larger transverse cross section. The front 126 and rear 128 end portions of the machine chassis 24 can be equipped with equipment for interfacing with other railway cars or with track equipment, for example shock pads 26 at the front end 126 and a coupling 28 for connection to the additional car 16 at the rear end 128. As shown in the figure, the additional car 16 comprises an additional chassis 30 coupled to the machine chassis 24 of the works machine 14 and borne in a manner independent of the works machine 12, by at least one additional truck 32. The machine chassis 24 is able to bear various items of equipment, such as a drivers cab 34 and a control station 36, as well as, if applicable, a hydraulic unit 37 which can comprise, for example, a hydraulic pump for supplying various hydraulic motors located in particular on the works shuttle 18.

The works shuttle 18 comprises a shuttle chassis 38 which is carried by the first truck 20 and the second truck 22, as well as one or more works units 40, in this case tamping units, which are suspended on the shuttle chassis 38 and are movable with respect to the shuttle chassis 38 in a direction perpendicular to the plane defined by the rails of the rail track 12 (i.e. a vertical direction when the works machine 14 is moving on a horizontal rail track 12). The first truck 20 is guided in rotation with respect to the shuttle chassis 38 so as to pivot at least about a first vertical pivot axis 120, the second truck 22 is guided in rotation with respect to the shuttle chassis so as to pivot at least about a second vertical pivot axis 122, the second vertical pivot axis 122 preferably being located at a distance D from the first vertical pivot axis 120 that is greater than 10 meters, preferably greater than 12 meters.

Figure 5:
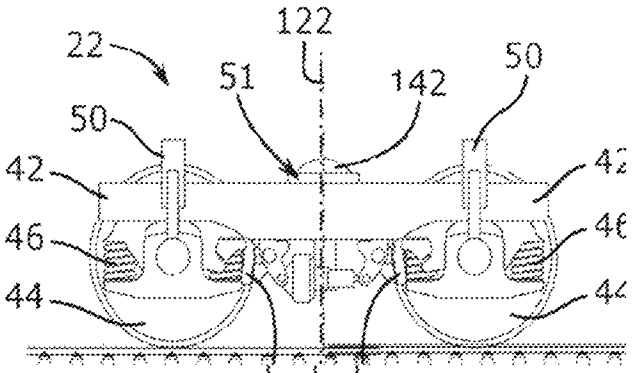
FIG. 5 is a schematic view of a second truck bearing the shuttle chassis of the works machine of FIG. 3.
Figure 4:
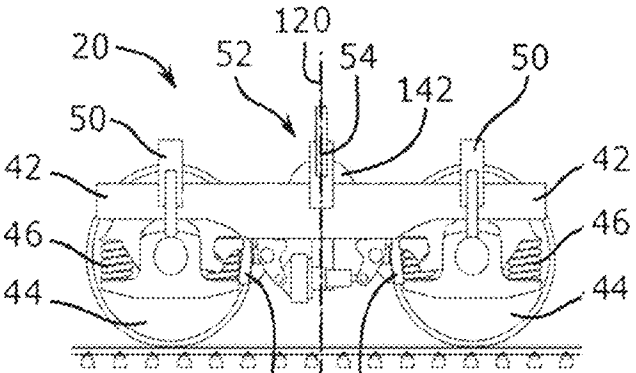
FIG. 4 is a schematic view of a first truck bearing the shuttle chassis of the works machine of FIG. 3.

The first truck 20, illustrated in detail in FIG. 4, and the second truck 22, illustrated in FIG. 5, each comprise a truck chassis 42, two motorized wheel sets 44 and a primary suspension 46 between the wheel sets 44 and the truck chassis 42. The wheel sets 44 are provided with service brakes 48. The primary suspensions 46 of the first truck 20 and of the second truck 22 preferably comprise a blocking mechanism 50 which is capable of vertically blocking each of the wheel sets 44 with respect to the truck chassis 42 in at least the downward bearing direction of the truck chassis 42 on each of the wheel sets 44. Said blocking mechanism 50 may be made up of hydraulic jacks, the piston of which is rigidly connected for example to the axle box, and the cylinder is secured to the truck chassis 42. The two truck chassis 42 are connected to the shuttle chassis 38 via a center plate 142.

Figure 6:
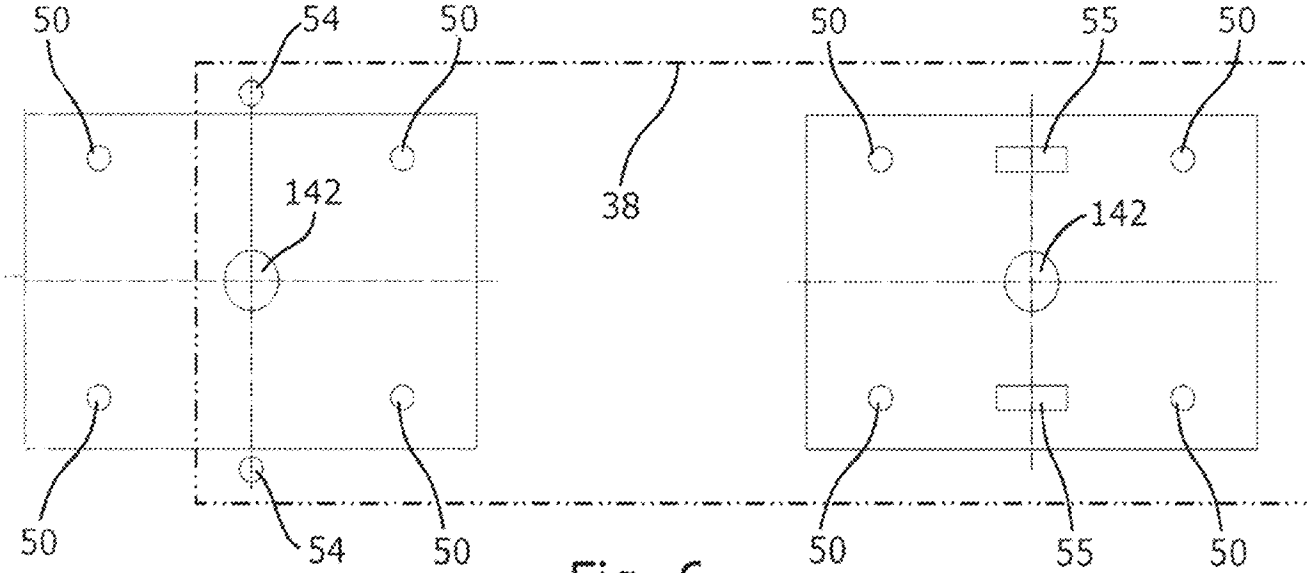
FIG. 6 is a schematic plan view of the two trucks of FIGS. 4 and 5.

Furthermore, at least one of the two trucks 20, 22, for example the first truck 20, which is intended to be positioned in front of the machine when this advances in the work direction 100 on the rail track 12, can be equipped with a vertical blocking device 52 for preventing a vertical relative movement between the truck 20 and the shuttle chassis 38. Said device 60 may comprise two retractable lateral support jacks 54 which may be guided hydraulically so as to pass from a retracted position into an operational position in which they constitute two lateral supports between the shuttle chassis 38 and the truck chassis 42, thus securing the truck chassis 42 to the shuttle chassis 38, in the vertical direction, as shown in FIG. 6, while the rear part of the shuttle chassis 38 rests on axle bars 65 with which the truck chassis 42 of the second truck 22 is equipped. The shuttle chassis 38 can thus retain its horizontal orientation on a horizontal track, or retain a controlled predetermined angle on a sloping track.

The shuttle chassis 38 is linked to the machine chassis 24 by longitudinal guide means that allow a relative back and forth movement, between two end-of-travel positions, between the works shuttle 18 and the machine chassis 24 in a longitudinal direction of the works machine 14, while preventing vertical and lateral movements. Said longitudinal guide means comprise a first longitudinal rolling interface 66 that is closer to the first truck 20 than to the second truck 22, and a second longitudinal rolling interface 58 that is closer to the second truck 22 than to the first 20, as shown in FIGS. 3 and 7 to 10.

Figure 7:
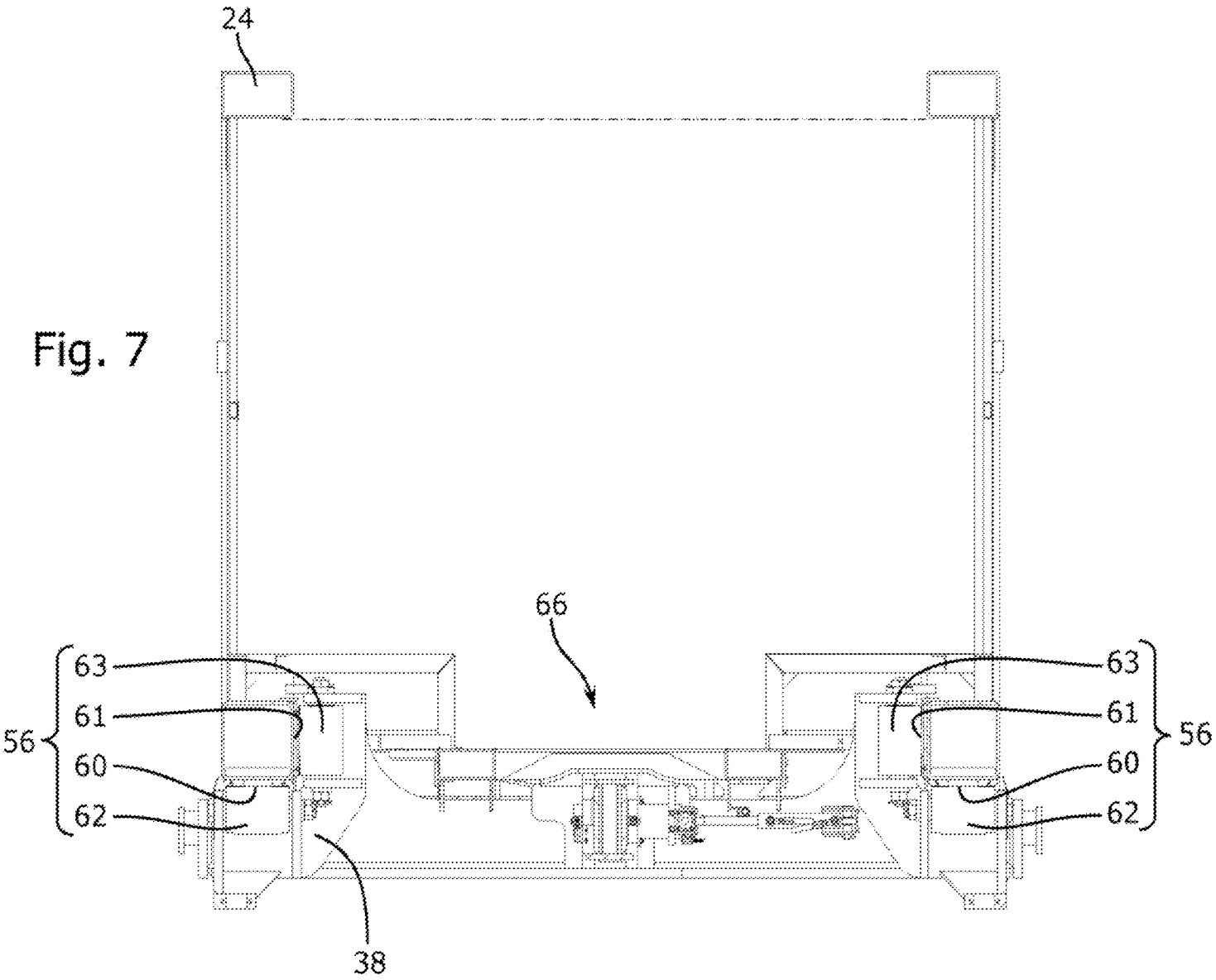
FIG. 7 is a cross-sectional view in a cutting plane VII-VII of FIG. 1, making it possible to see a first rolling interface as well as a first locking device between the machine chassis and the shuttle chassis.
Figure 8:
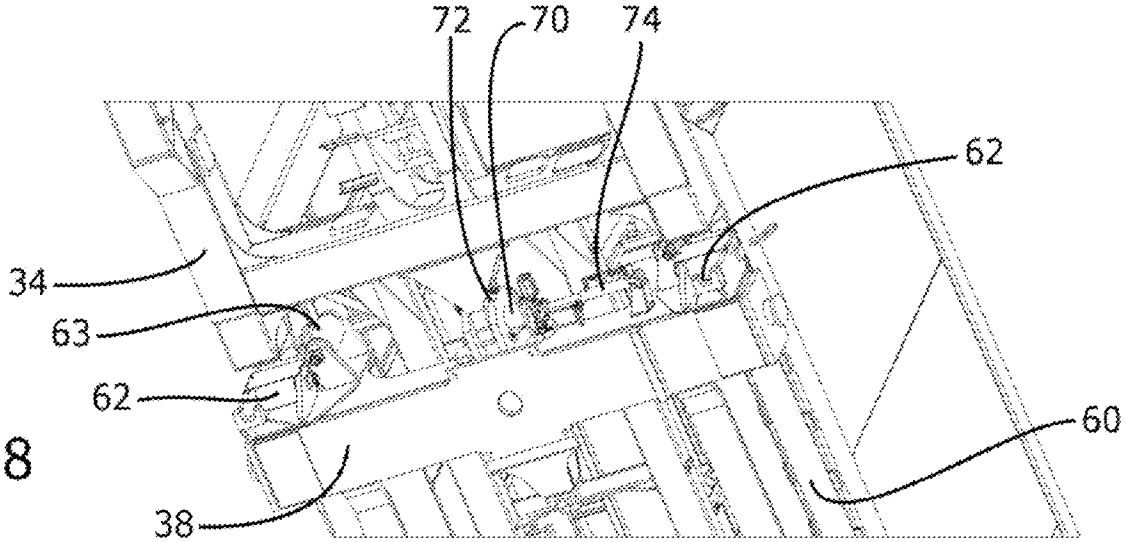
FIG. 8 is an isometric view of the cross section of FIG. 7.
Figure 10:
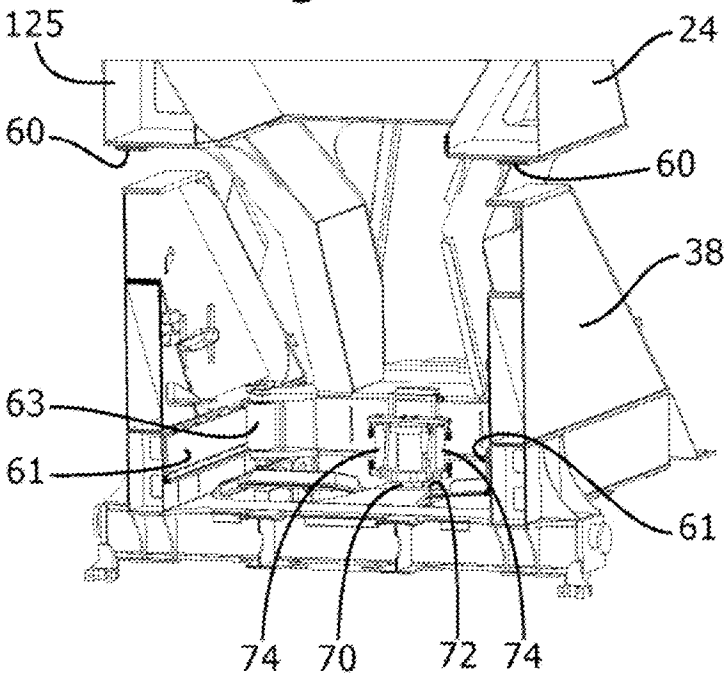
FIG. 10 is an isometric view of the cross section of FIG. 7.
Figure 9:
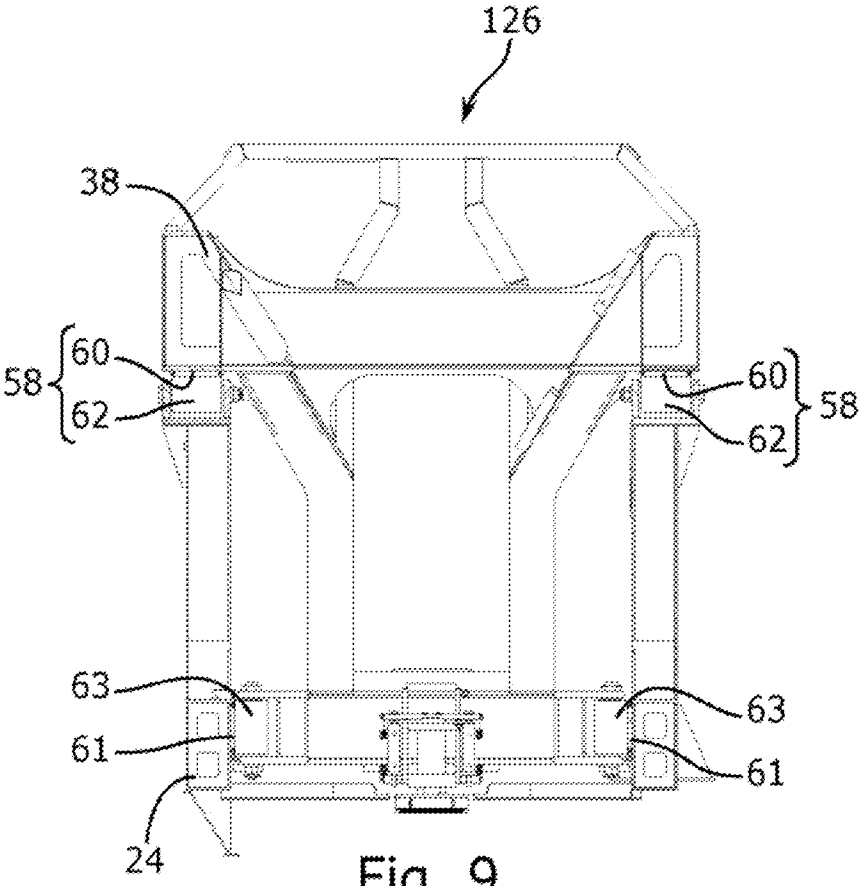
FIG. 9 is a cross-sectional view in a cutting plane IX-IX of FIG. 1, making it possible to see a first rolling interface as well as a first locking device between the machine chassis and the shuttle chassis.

The first rolling interface 66, illustrated in detail in FIGS. 7 and 8, and the second rolling interface 58, illustrated in detail in FIGS. 9 and 10, each comprise at least one longitudinal raceway 60 and, in this case, each comprise two parallel horizontal longitudinal raceways 60, two parallel vertical longitudinal raceways 61, and at least one roller 62, 63 associated with each longitudinal raceway 60, 61, the roller 62, 63 being capable of rolling on the associated raceway 60, 61 in order to allow for the back and forth relative movement between the shuttle chassis 38 and the machine chassis 24, the longitudinal raceway 60, 61 being secured to one of the two subassemblies formed by the machine chassis 24 and the shuttle chassis 38, in this case the machine chassis 24, while the associated roller 62, 63 is translationally secured to the other of the subassemblies, i.e. the shuttle chassis 38. In FIG. 3, it can be seen that the horizontal axes of rotation of the rollers 62 of the first rolling interface 56 and of the second rolling interface 60 are located between the front wheel set 44 of the first truck 20 and the rear wheel set 44 of the second truck 22. The same preferably applies for the vertical axes of the rollers 63 of the two rolling interfaces 56, 58. This contributes to good stability of the assembly and a good distribution of loads between the two trucks. Ideally, the axes of rotation of at least some of the rollers 62, 63, and preferably of all the rollers 62, 63, are positioned longitudinally between the pivot axes 120 and 122 of the two trucks.

Figure 11:
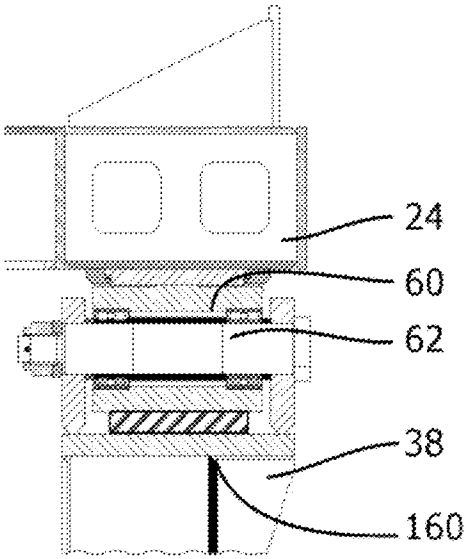
FIG. 11 is a detailed view of an alternative rolling interface between a machine chassis and a shuttle chassis of the tamping machine of FIG. 3.

In a variant, shown in FIG. 11, it is possible to provide one or more rollers 62, 63 which roll simultaneously on a longitudinal raceway 60, 61 that is secured to the machine chassis 24 and an opposing longitudinal raceway 160 which is secured to the shuttle chassis 38.

The weight of the body of the machine, constituted by the machine chassis 24 and the machine elements which it carries, is transmitted integrally to the shuttle chassis 38 by the two rolling interfaces 56, 68, which are located on either side of the center of gravity of the body of the machine, such that, when stopped on a horizontal rail track, a load distribution ratio between the first rolling interface 56 and the second rolling interface 58 is between 60% and 140% for every relative position of the machine chassis 24 and of the works shuttle 18 between the two end-of-travel positions. Furthermore, the load distribution on the works shuttle 18 and the machine chassis 24 is such that, in a median relative position of the machine chassis 24 and of the shuttle chassis 18, halfway between the two end-of-travel positions, stopped on a horizontal rail track, each of the trucks 20, 22 bears at least 40% and at most 60% of the total weight of the works machine 14.

The works machine 14 is provided with a longitudinal locking device which is capable of securing the machine chassis to the shuttle chassis in a position referred to as the movement position. Said locking device comprises at least two locks 66, 68, which are each located close to a longitudinal end of the shuttle chassis 38 and one of the rolling interfaces 56, 58, as shown in particular in FIGS. 7 and 8. The lock 66 comprises a bolt 70 which is mounted on one of the two subassemblies formed by the machine chassis 24 and the shuttle chassis 38, in this case the shuttle chassis 38, and a striker plate 72 which is mounted on the other of the two subassemblies, in this example the machine chassis 24. The bolt 70 is movable with respect to the subassembly on which it is mounted, between a retracted position and a locking position, and is connected to an actuator 74, formed in this case by a hydraulic jack. In a similar manner, it can be seen that the lock 68 shown in FIGS. 9 and 10 comprises a bolt 70 which is mounted on one of the two subassemblies formed by the machine chassis 24 and the shuttle chassis 38, in this case the machine chassis 24, and a striker plate 72 which is mounted on the other of the two subassemblies, in this example the shuttle chassis 38. The bolt 70 is movable with respect to the subassembly on which it is mounted, between a retracted position and a locking position, and is connected to an actuator 74, formed in this case by two parallel hydraulic jacks.

When the machine chassis 24 is positioned in the position for travel, with respect to the shuttle chassis 38, the bolts 70 of the locks 66, 68, passing from their retracted position into their locking position, penetrate the striker plates 72 and achieve the desired securing, respectively between the front 124 longitudinal end portion of the machine chassis 24 and the shuttle chassis 38, and between the rear 126 longitudinal end portion of the machine chassis 24 and the shuttle chassis 38. The shuttle chassis 38 and the machine chassis 24 thus form a structural entity, such that some of the stresses exerted on the shock pads 26, or more generally the interface at the end 126 of the machine chassis 24, is transmitted to the coupling 28, or more generally to the interface at the end 128 of the machine chassis, passing via the locks 66, 68 and the shuttle chassis 38, accordingly relieving the bridge 125 of the machine chassis 24 accordingly.

The works machine 14 is preferably equipped with at least one assistance actuator 82 which connects the machine chassis 24 to the shuttle chassis 38 and has a course of travel that corresponds to the relative course of travel between the shuttle chassis 38 and the machine chassis 24, between the two end-of-travel positions. Said assistance actuator 82 may be formed by a hydraulic jack, preferably a jack having two chambers. A jack of this kind makes it possible, by isolating each of the chambers, to block the machine chassis 24 with respect to the shuttle chassis 38, in any intermediate position between the two end-of-travel positions. It also makes it possible to drive the machine chassis 24 with respect to the shuttle chassis 38 in a back and forth movement between the two end-of-travel positions. In a variant, it is possible to provide an actuator that is formed of two hydraulic jacks that are arranged in opposition, each of the jacks managing the blocking in one direction and the movement in the opposite direction.

The works units 40 carried by the shuttle chassis comprise picks 84 mounted on a common frame 86 that is guided so as to move vertically with respect to the shuttle chassis, between a retracted position, vertically remote from the rail track, and a work position, plunging into the ballast between two adjacent sleepers 88 of the rail track 12. Said picks 84 are motorized so as to be able to vibrate about an average position when they are plunged into the ballast, in order to perform the work operation. However, it is only provided for the frame 86 of the works units 40 to be movable longitudinally with respect to the shuttle chassis 38.

If applicable, the works machine 14 and the additional car 16 can be provided so as to function in tandem, for example if it is provided for the additional car 16 to carry a motor group for supplying hydraulic power to the hydraulic drive motors mounted on the trucks 20, 22, or the works units 40.

The works machine 14 functions in the following manner.

In a mode of operation which can be referred to as the work mode, the convoy 10 advances at a constant work speed, in a predetermined work direction 100, for example towards the left in FIG. 1. Said constant speed is in particular that of the additional car coupled to the works machine, and is thus also that of the machine chassis 24. In practice it is very low, by way of example less than 5 km/hour.

In the work mode, the machine chassis 24 is pushed by the chassis of the additional car 16 located directly behind the works machine 14, or pulled by an additional car located directly in front of the works machine 14, and thus advances at the work speed, in the work direction 100. The works units 40 must, in turn, alternate stationary phases with respect to the track, in order to allow for penetration of the picks 84 into the ballast and the tamping operation, and rapid advance phases. During the stationary phases, the trucks 20, 22 are stationary and the shuttle chassis 38, stopped with respect to the rail track 12, progressively moves backwards with respect to the machine chassis 24, towards the rear end-of-travel position. During the rapid advance phases, the works units 40 are at a distance from the track, and the shuttle chassis 38 accelerates rapidly from the stopped position thereof in the work direction 100, in order to reach a speed higher than the work speed, and to progress forwards with respect to the machine chassis and with respect to the track, before decelerating rapidly to a stop, so as to position the works units 40 above the portion of the rail track 12 directly adjacent to the portion already treated. The driving of the shuttle chassis 38 can be performed by hydraulic motors for driving motorized wheel sets 44 of the trucks 20, 22, if applicable assisted by the hydraulic jack 82. The decelerations can also be obtained by the hydraulic motors which are driven so as to function as pumps in the case of reversible hydraulic machines, or by the service brakes 48, or by the hydraulic assistance jack 82, or by a combination of these different means.

The course of travel which the shuttle chassis 38 has to cover with respect to the machine chassis 24, at each rapid advance phase, in the work direction, is substantially equal to the course of travel covered by the machine chassis 24 with respect to the rail track 12, in the work direction 100, during the stationary phase, and thus to the product of the work speed and the stopped time of the shuttle chassis 38 with respect to the rail track 12 in the stationary phase. These courses of travel must of course remain within the space delimited by the end-of-travel positions. In practice, the end-of-travel positions are at least 1 meter, preferably at least 1.5 meters, apart from one another.

In the work mode, it is advantageously possible to operate the blocking mechanism 50 of the primary suspensions of the two trucks 20, 22, in order to rigidify the trucks 20, 22. It is also possible to operate the device 52 for vertical blocking of one of the trucks 20 with respect to the shuttle chassis 38, for more accurate control of the position of the shuttle chassis 38 with respect to the rail track 12, in all spatial directions. Ideally, the blocking device is actuated intermittently, only when the trucks 20, 22 are stopped, and is released when the shuttle advances towards its next work position.

It goes without saying that, in the work operating mode, the longitudinal locking device 66, 68 is not engaged. If it proves necessary, on a construction site, to interrupt the work mode over some meters, for example for the passage of an item of track equipment, such as points, it is possible to use the hydraulic assistance jack 82 as an additional longitudinal locking device.

When they are not in work mode, the works machine 14 and the convoy 10 are able to travel on the rail track 12 at a speed significantly higher than the work speed, for example at more than 10 km/hour, in order for example to travel to or leave a construction site. In order to allow for a movement of this kind, the blocking mechanism 50 of the primary suspensions 46, as well as the rotational locking device 54 of one of the trucks, are released, and the machine chassis 24 is secured to the shuttle chassis 38 in the position for travel, by means of the longitudinal locking device 66, 68.

In practice, the machine chassis 24 is positioned, with respect to the shuttle chassis 38, precisely in the position for travel, by means of the hydraulic assistance jack 82, or the motorized trucks 20, 22, and then one of the locking devices 66, 68 is engaged. Very slight structural play is retained between the bolt and the striker plate, in order to make it possible, if applicable after very slight position adjustment by means of the hydraulic assistance jack 82, or motorized trucks 20, 22, to engage the other locking device.

The locks 66, 68 of the longitudinal locking device are dimensioned so as to withstand significant stresses corresponding to a sudden stop of the machine chassis 24 when the pads 26 collide with an obstacle when the train 10 is moving at a movement speed that is higher than the work speed. In practice, each of said locks 66, 68 is capable of withstanding a critical load exceeding 500 kN (or if applicable exceeding 900 kN, and preferably exceeding 1500 kN) in the longitudinal direction. Thus, the locks 66, 68 of the longitudinal locking device make it possible to transmit at least some of the buffering stresses longitudinally from the pads 26 to the coupling 28, passing via the locks 66, 68 and the shuttle chassis 38. It is thus possible to accept relatively lightweight dimensioning of the machine chassis 24 in the thinner part 125 thereof, because the machine chassis 24 does not have to transfer all the buffering stresses.

Of course, the examples shown in the drawings and discussed above are given merely by way of example and are non-limiting. It is explicitly provided that it is possible to combine the different embodiments shown with one another, in order to suggest others.

Figure 12:
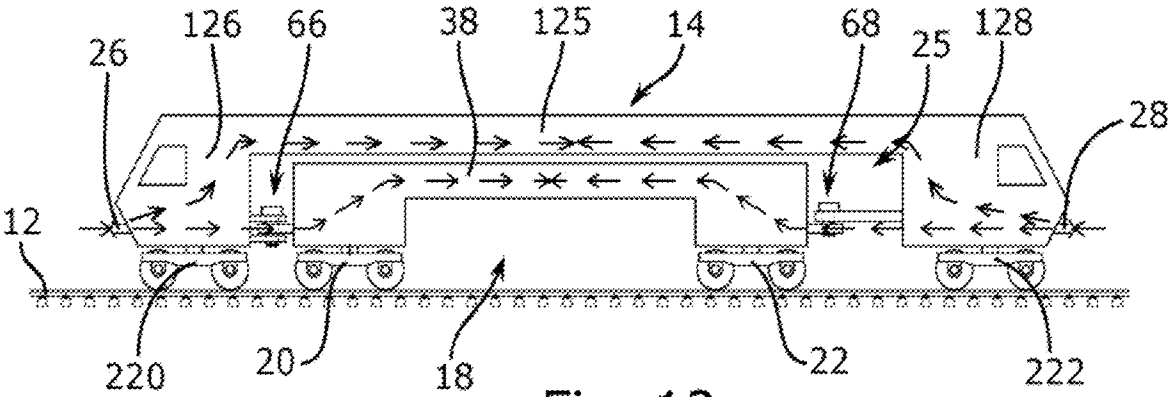
FIG. 12 is a schematic view of a works machine according to another embodiment of the invention.

A works machine 14 according to another embodiment has been shown schematically in FIG. 12. Said works machine 14 comprises a works shuttle 18 comprising a shuttle chassis 38 that is carried by a first truck 20 and a second truck 22 located longitudinally at a distance from one another, as well as a machine chassis 24 that is also carried by a first truck 220 and a second truck 222 that are located longitudinally at a distance from one another. The machine chassis 24 comprises a longitudinal recess 25 for housing the works shuttle 18, said longitudinal recess 25 being spanned by a longitudinal bridge 125 having a small cross section that constitutes a median portion of the machine chassis 24 and connects two opposing longitudinal end portions 126, 128 having a larger transverse cross section. The front 126 and rear 128 end portions of the machine chassis 24 can be equipped with equipment for interfacing with other rail cars or with track equipment, for example shock pads 26, 28. The works machine 14 is furthermore provided with two locking devices 66, 68, one arranged between the shuttle chassis 38 and the front end portion 126 of the machine chassis 24, the other between the shuttle chassis 38 and the rear end portion 128 of the machine chassis 24. When the works machine is in work mode, the locking devices 66, 68 are open and retracted, which allows the shuttle 18 to move longitudinally with respect to the machine chassis 24. When the works machine 14 has to travel on the rail track at a higher speed, the shuttle chassis 38 is secured to the machine chassis 24 in the position for travel illustrated in FIG. 12, by activating the locking devices 66, 68. In this mode of operation, referred to as travel, a substantial portion of the longitudinal stresses exerted on the interfacing equipment 26, 28 passes through the locking devices 66, 68 and the shuttle chassis 38, which relieves the medial portion 126 of the machine chassis 24.

It is emphasized that all the features, as they follow for a person skilled in the art from the present description, the drawings, and the accompanying claims, even if they have been specifically described only in relation with other specific features, both individually and in any combination, can be combined with other features or groups of features disclosed herein, provided that this is not explicitly excluded or that technical circumstances render such combinations impossible or meaningless.

The invention claimed is:

1. A railway works machine comprises:

a machine chassis; and a works shuttle, the machine chassis having two opposite longitudinal end portions and a middle portion connecting the opposite longitudinal end portions, a volume being created underneath the middle portion of the machine chassis to house at least part of the works shuttle, the works shuttle comprising a shuttle chassis and at least one works unit, the shuttle chassis being able to move with respect to the machine chassis, in a longitudinal direction of the works machine, back and forth between two end-of-travel positions, the works machine further comprising a longitudinal locking system which is capable of securing the machine chassis to the shuttle chassis in a position for travel, wherein the longitudinal locking system comprises a first positive engagement locking device between a first of the two longitudinal end portions and the shuttle chassis and a second positive engagement locking device between the shuttle chassis and a second of the two longitudinal end portions, each of the first positive engagement locking device and the second positive engagement locking device capable of withstanding a critical load exceeding 500 kN, in the longitudinal direction.

2. The railway works machine of claim 1, wherein the two opposite longitudinal end portions are each equipped with an end interface that belongs to a group of interfaces comprising shock pads and a coupling for connection to an adjacent vehicle of a works convoy.

3. The railway works machine of claim 1, wherein the works unit comprises work tools that are intended to work on a track when the works shuttle is stopped.

4. The railway works machine of claim 3, wherein the works unit comprises a carrying structure that is capable of raising and lowering the work tools between a retracted position and a work position.

5. The railway works machine of claim 1, further comprising at least one assistance actuator, connecting the machine chassis to the shuttle chassis, capable of performing one or more of the following operations:

blocking the shuttle chassis with respect to the machine chassis in any intermediate position between the two end-of-travel positions;

driving the shuttle chassis with respect to the machine chassis in a longitudinal direction of the works machine, in a back and forth movement between the two end-of-travel positions.

6. The railway works machine of claim 1, wherein the end-of-travel positions are at least 1 meter, apart from one another.

7. The railway works machine of claim 1, further comprising at least two trucks, which have vertical pivot axes that are located at a distance (D) from one another of more than 10 meters.

8. The railway works machine of claim 7, wherein the two trucks bear the shuttle chassis, which bears the machine chassis.

9. The railway works machine of claim 7, wherein the two trucks bear the machine chassis, on which the shuttle chassis is suspended in the position for travel.

10. The railway works machine of claim 7, wherein the two trucks bear the machine chassis, and in that the railway works machine comprises two additional trucks which bear the machine chassis.

11. The railway works machine of claim 1, wherein each of the first positive engagement locking device and the second positive engagement locking device comprises a bolt that is mounted on one of two subassemblies formed by the machine chassis and the shuttle chassis, and a striker plate mounted on another of the two subassemblies formed by the machine chassis and the shuttle chassis, the bolt being movable with respect to the subassembly on which it is mounted, between a locking position and a retracted position, the bolt penetrating into the striker plate, passing from the retracted position into the locking position.

12. The railway works convoy comprising the railway works machine of claim 1, and at least one additional car comprising an additional chassis coupled to the machine chassis of the works machine, and at least one additional truck for bearing the additional chassis.

13. The railway works convoy of claim 12, wherein each of the first positive engagement locking device and the second positive engagement locking device are capable of withstanding a load generated by the at least one additional car in the longitudinal direction.

14. The railway works machine of claim 1, wherein each of the first positive engagement locking device and the second positive engagement locking device are capable of withstanding a critical load exceeding 1,500 kN in the longitudinal direction.

15. The railway works machine of claim 3, wherein the work tools are tamping or compacting tools.

16. The railway works machine of claim 4, wherein the carrying structure is capable of raising and lowering the work tools between the retracted position and the work position by means of a purely vertical movement.

17. The railway works machine comprising a railway works machine of claim 5, wherein the at least one assistance actuator comprises one or more hydraulic jacks.

18. The railway works machine comprising a railway works machine of claim 6, wherein the end-of-travel positions are at least 1.5 meters apart from one another.

19. The railway works machine comprising a railway works machine of claim 7, wherein the at least two trucks are motorized.

20. The railway works machine of claim 1, wherein a distance (D) between the vertical pivot axes is more than 12 meters.

* * * * *